United States Patent [19]

Jun

[11] 4,033,624

[45] July 5, 1977

[54] INVALID WHEEL-CHAIR

[76] Inventor: Wilhelm Meyer Jun, Kirchstrasse 7, 4973 Vlotho, Weser, Germany

[22] Filed: June 2, 1976

[21] Appl. No.: 692,214

[30] Foreign Application Priority Data

Apr. 2, 1976 Germany ..... 7610263[U]

[52] U.S. Cl. ..... 297/434; 297/DIG. 4

[51] Int. Cl.[2] ..... A47C 7/50

[58] Field of Search ..... 297/433, 434, DIG. 4

[56] References Cited

UNITED STATES PATENTS

| | | | |
|---|---|---|---|
| 2,991,831 | 7/1961 | Jennings | 297/434 |
| 3,000,632 | 9/1961 | Fuchs | 297/433 X |
| 3,249,388 | 5/1966 | Jennings | 297/DIG. 4 |

*Primary Examiner*—James C. Mitchell

*Attorney, Agent, or Firm*—Ostrolenk, Faber, Gerb & Soffen

[57] ABSTRACT

A wheeled invalid-chair has leg-supports provided with levers for an invalid seated in the chair to adjust the inclination of the leg-supports. Each leg-support comprises a carrier spar pivoted at its upper end to the chair frame and supporting a foot rest at its lower end and a leg rest intermediate its ends. The lever is hinged to the carrier-spar, and can be swung from a position alongside the carrier-spar to engage an abutment provided by the rounded upper end of the carrier spar for adjusting the pivotal position of the leg support relative to the frame by pulling on the lever. A locking mechanism is connected between each leg support and the frame for locking the leg-support in the adjusted position.

10 Claims, 3 Drawing Figures

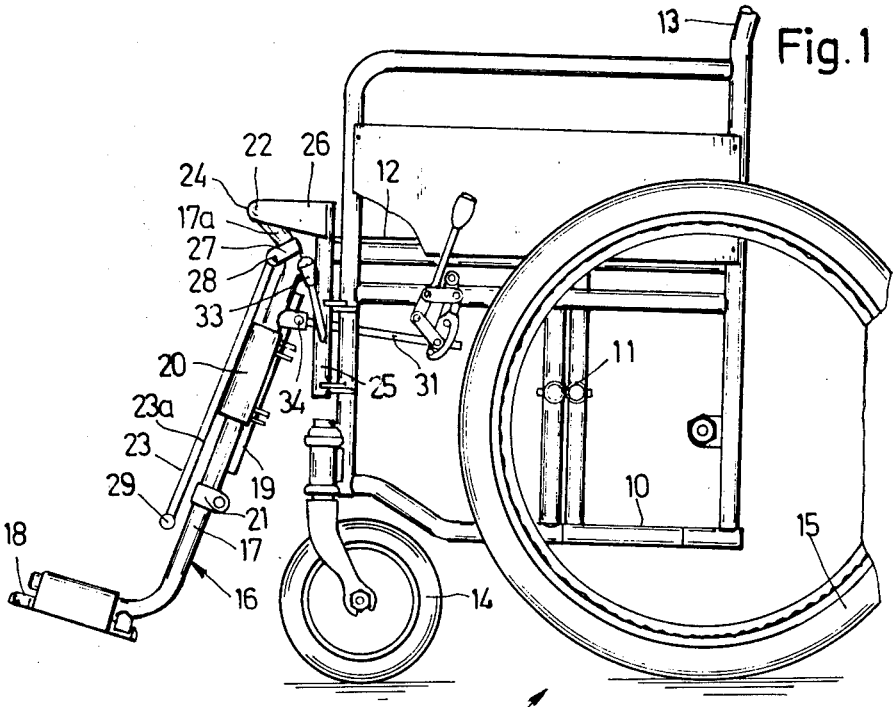
Fig. 1
Fig. 3
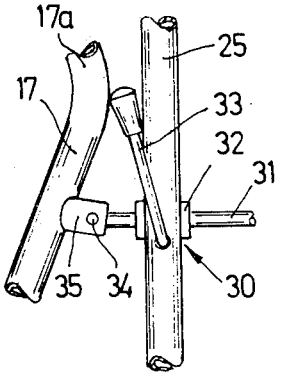
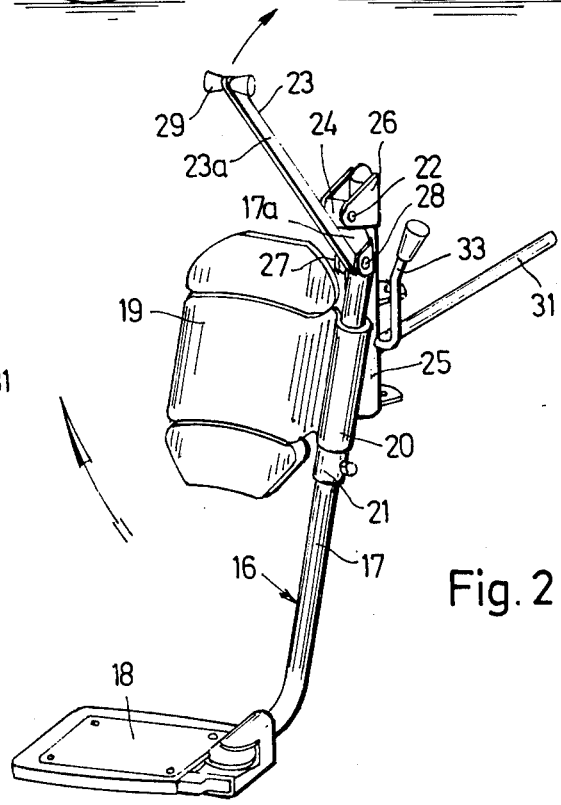
Fig. 2

INVALID WHEEL-CHAIR

This invention relates to a wheeled invalid-chair with adjustable leg-supports each having a carrier-spar with a footrest at its bottom end.

A handicapped person seated in a wheeled invalid-chair should be able without shifting his body to move the leg-support conveniently into desired positions.

The present invention aims at providing a wheeled invalid-chair with simply constructed leg-supports which can be operated easily and without effort by a handicapped person to bring them with into desired positions.

In accordance with the invention there is provided a wheeled invalid-chair comprising a frame, and leg-supports each having a carrier-spar with an upper end connected to the frame to pivot relative thereto about a horizontal axis, a footplate carried on the lower end of the spar, and an actuating lever hinged to the carrier-spar at a position spaced from the horizontal axis, the actuating lever being cooperable with an abutment on the frame for pivoting the leg-support upwardly about the axis.

With this construction leg-support construct is simple, cheap, longlasting and secure in action.

In a preferred embodiment the carrier-spar is supported at its top end in a supporting-fork on the frame about a pivot, and, at a distance below this supporting-fork, the actuating lever which is formed by a metal tube or rod has one end connected to the carrier-spar by a horizontal pivot. A longitudinal edge of the actuating lever, forms a bearing surface which acts against the abutment face which is formed by the top free end face of the carrier-spar suitably rounded off, to the leg-supports, the actuating lever is seized by the handicapped person, swung up and then swung further towards the person, so that the actuating lever butts against the endface of the carrier-spar and pivots the carrier-spar with it about its pivot, so that the carrier-spar gets moved into the desired position. The position adjusted of the leg supports can be locked by a suitable locking mechanism, such as a gas-spring, a sliderod pivoted to the carrier-spar and slidable in, but lockable relative to a guide bush carried by the frame.

The leg-support is movable by the actuating lever which can be reached by a handicapped person seated in the wheeled invalid-chair without shifting his body, with little expenditure of effort into the adjusting position. By coupling of the actuating lever with the carrier-spar of the leg-support and by the engagement of the actuating lever against the top end of the carrier-spar, the leg-support can be adjusted conveniently and without effort by the user with a simple pull on the actuating lever towards the user.

The means of adjustment can be produced simply and cheaply, have a long working life and secure operation.

Moreover each leg-support can be securely locked in position by the simple locking mechanism which is also arranged to be easily reached and operated by the user without shifting his body.

The very simple construction and the simple structural means for the adjustment of the leg-supports and the very light ensures effortless operability without shifting of the body, especially bending of the body forwards, whereby the handicapped person when adjusting the leg-supports preserves his safe seated position.

An embodiment of the invention will now be described in detail, by way of example, with reference to the accompanying drawings, in which:

FIG. 1 is a side elevation of a wheeled invalid-chair in accordance with the invention;

FIG. 2 is a perspective of one of the leg-supports of the wheeled invalid-chair; and FIG. 3 is a side elevation of a mechanism for locking the leg-support in an adjusted position.

The illustrated invalid chair has a frame 10 with opposite sides which can be folded together thanks to a knuckle joint 11. The frame carries a seat 12, a backrest 13, steerable front wheels 14 and manually or motor driven rear wheels 15.

Supported on the frame 10 at the front of each of its sides is a leg-support 16 in the form of a tubular carrier-spar 17, and a foot-plate 18. A leg rest 19 is mounted on the tubular carrier-spar 17 above the foot-plate 18, and takes the form of a concave plate which is attached to the carrier-spar 17 by a sleeve 20 with a setting-ring 21 which allows the height of the leg rest to be adjusted. The carrier-spar 17 of each leg-support 16 is supported at its upper end by the wheel frame 10 to be about a horizontal pivot 22, below the pivot 22, an actuating lever 23 is hinged to the carrier-spar 17, for co-operation with an abutment face 24 on the frame 10 for swinging the leg-support 16 about the pivot 22.

For each leg-support 16, a support tube 25 is attached to the front of the frame 10, to extend vertically. The tube 25 carries at its upper end a fork 26 which mounts the pivot 22. The top end **17*a* of the carrier-spar 17 is bent forwards and the pivot 22 is located at the free end of the supporting fork 26 at a distance from the supporting tube 25**.

In the region of the bend in the carrier-spar 17, the actuating lever 23 formed, for example of metal such as steel of aluminium and as a rod of circular or angular or other cross-section, is hinged to the spar 17 by a bracket 27 and pivot 28. To adjust the leg-support the lever 23 is rotated by hand by a handicapped person seated in the invalid-chair from the position illustrated in FIG. 1 to that illustrated in FIG. 2.

At its free end, the actuating lever 23 carries a handle 29, and its longitudinal edge **23*a* forms a bearing-surface for co-operation with the abutment face 24**.

In the rest position i.e., in the normal position as shown in FIG. 1 the lever 23 extends parallel with and along side the carrier-spar 17.

The abutment face 24 which co-operates with the actuating lever 23 in the region of the pivot 22 is formed by the free end of the carrier-spar 17, which is formed rounded off and closed to form a cylindrical contact surface. If it is wished to adjust the leg support 16 the person grasps the actuating lever 23 at any convenient position along its whole length. The lever 23 is then swung up to bring its bearing surface **23*a* into contact with the abutment face 24, when the handle 29 can be grasped to provide a good leverage for adjusting the leg-support. The actuating lever 23 is then swung up and towards the user, causing the leg-support 16 to swing up with it, since the lever 23 and the carrier-spar 17 are connected rigidly to move together. The swinging of the actuating lever 23 in the direction of the arrow as FIG. 2, is continued until the desired position of the leg-support 16** is reached. The leg-support is locked in the adjusted position by a locking mechanism 30 which holds the leg-support 16 firmly in the adjusted position. Once the leg-support is locked, the lever 23 can be swung down again to the position shown in FIG. 1.

The locking mechanism 30 may be a gas spring located between and pivotally connected to the supporting tube 25 and the carrier-spar 17, the gas spring acting automatically in both directions. In the illustrated embodiment the locking mechanism 30 comprises a sliderod 31 hinged to the carrier-spar 17, and which passes through a guide bush 32 fixed to the supporting tube 25. A locking lever 33 engages the guide bush 32 for locking the sliderod 31 with respect to the guide bush 32 by a clamppiece, such as a cam. The sliderod 31 is hinged to the spar 17 by a pivot 34 and a bracket 35 fixed on the carrier-spar 17. The locking lever 33 is positioned to be easily accessible below the seat 12 at the side on the frame.

I claim:

1. A wheeled invalid-chair comprising a frame, and leg-supports, said leg-supports each having a carrier-spar with upper and lower ends, pivot means connecting said upper end of said carrier-spar to said frame to pivot relative thereto about a horizontal axis, a foot rest plate carried by said carrier-spar at said lower end thereof, an actuating lever and hinge means connecting said lever to said carrier-spar at a position spaced from said horizontal axis, said frame having abutment means engageable by said lever for pivoting said leg support about said axis to adjust the position thereof relative to said frame.

2. A wheeled invalid-chair as claimed in claim 1, wherein said frame has for each carrier spar a supporting member and a supporting fork is attached to said support member, said pivot means is supported by said fork, and said carrier-spar has an upper end portion which is bent forward and connected to said pivot means.

3. A wheeled invalid-chair as claimed in claim 2, wherein said lever has opposite ends, said hinge means connects one said end of said lever to said spar in the region of the bend in said carrier-spar and underneath said pivot means, and said actuating lever having a longitudinal edge which forms a bearing surface for engagement with said abutment means.

4. A wheeled invalid-chair as claimed in claim 3, wherein the abutment means lies in the region of said pivot means and is formed by said upper end of said carrier-spar, which said end is rounded off.

5. A wheeled invalid-chair as claimed in claim 1, wherein said actuating lever is a tube or rod having opposite ends, said hinge means connects one said end to said carrier-spar for pivotal movement about a horizontal axis, and comprises a pivot and a bracket fixed to the carrier-spar and carrying said pivot, the other said end of said lever having a handle.

6. A wheeled invalid-chair as claimed in claim 3, wherein said actuating lever has a rest position in which said lever extends parallel with said carrier-spar, and said hinge means lies between said pivot means and said supporting member, and underneath said supporting fork.

7. A wheeled invalid-chair as claimed in claim 3, wherein locking means is connected between said carrier-spar and said supporting member for locking the leg-support in position relative to said frame, said locking means comprising a sliderod hinged to said carrier-spar, a guide sleeve attached to said supporting member said sliderod extending slidably through said guide sleeve and means for locking said sliderod to said guide sleeve for locking the leg-support in position relative to said frame.

8. A wheeled invalid-chair as claimed in claim 1, wherein said actuating lever is made from metal.

9. A wheeled invalid-chair as claimed in claim 1, wherein a leg rest is supported on said carrier-spar intermediate the ends thereof, and means are provided for adjusting the height of said leg rest.

10. A wheeled invalid-chair as claimed in claim 9, wherein the leg rest is a concave plate, a sleeve supports said plate on said carrier-spar, and said height adjusting means comprises a ring which is adjustable in position along said carrier-spar.

* * * * *

UNITED STATES PATENT OFFICE
CERTIFICATE OF CORRECTION

Patent No. 4,033,624 Dated July 5, 1977

Inventor(s) Wilhelm Meyer, Jr.

It is certified that error appears in the above-identified patent and that said Letters Patent are hereby corrected as shown below:

Please correct the inventor's name from

Wilhelm Meyer, Jun. to --WILHELM MEYER, JR.--

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*